US007241136B2

(12) United States Patent
Lehoux et al.

(10) Patent No.: US 7,241,136 B2
(45) Date of Patent: Jul. 10, 2007

(54) CATALYTIC COMBUSTION BURNER MADE FROM A POROUS MATERIAL AND FLASK EQUIPPED WITH SUCH A BURNER

(75) Inventors: Jannick Lehoux, Thuit Signol (FR); Corinne Gomez, Incarville (FR)

(73) Assignee: Produits Berger (FR)

( * ) Notice: Subject to any disclaimer, the term of this patent is extended or adjusted under 35 U.S.C. 154(b) by 66 days.

(21) Appl. No.: 10/876,203

(22) Filed: Jun. 24, 2004

(65) Prior Publication Data

US 2005/0037309 A1 Feb. 17, 2005

(30) Foreign Application Priority Data

Jun. 27, 2003 (FR) ..... 03 07765

(51) Int. Cl.
*F23D 3/24* (2006.01)
*F23Q 11/04* (2006.01)

(52) U.S. Cl. ..... 431/324; 431/328; 431/268

(58) Field of Classification Search ..... 431/326, 431/328, 268, 320, 319, 323, 170, 7, 325, 431/324, 321; 60/723
See application file for complete search history.

(56) References Cited

U.S. PATENT DOCUMENTS 1,956,749 A * 5/1934 Terret ..... 431/268
2,938,343 A * 5/1960 Canfield ..... 60/736
3,240,256 A * 3/1966 Binkley et al. ..... 431/328
6,162,046 A * 12/2000 Young et al. ..... 431/11
6,537,061 B1 3/2003 Gomez et al.

FOREIGN PATENT DOCUMENTS

| | | | |
|---|---|---|---|
| DE | 34 36 310 A1 * | 4/1986 | |
| EP | 0 277 875 A1 | 8/1988 | |
| FR | 2 579 465 A * | 10/1986 | |
| FR | 2 821 749 A1 | 9/2002 | |
| JP | 3241212 | 10/1991 | |
| TW | 513531 | 12/2002 | |

* cited by examiner

*Primary Examiner*—Josiah C. Cocks
(74) *Attorney, Agent, or Firm*—Bachman & LaPointe

(57) ABSTRACT

The catalytic combustion burner made from a porous material is designed to cooperate with a wick that will carry a combustible composition to the burner that penetrates into the pores of the porous material, and comprises a peripheral zone that supports a catalyst and that surrounds a central zone without a catalyst forming a vaporization zone, the peripheral zone and the central zone being located in the upper part of the burner. The burner has a tapered peripheral surface flaring upwards.

9 Claims, 2 Drawing Sheets

CATALYTIC COMBUSTION BURNER MADE FROM A POROUS MATERIAL AND FLASK EQUIPPED WITH SUCH A BURNER

BACKGROUND OF THE INVENTION

This invention relates to a catalytic combustion burner made of a porous material suitable for cooperation with a wick that will carry an combustible composition to the burner penetrating into the pores of the said porous material, the said burner comprising a peripheral zone that supports a catalyst and that surrounds a central zone without a catalyst forming a vaporization zone, the peripheral zone and the central zone being located in the upper part of the burner.

Conventionally, this type of catalytic combustion burner has an approximately cylindrically shaped peripheral surface.

However, it is relatively difficult to manufacture burners with such an approximately cylindrically shaped peripheral surface.

Actually, many parts have to be scrapped during the mould removal step because they include weak zones, particularly around the periphery of the burner.

Even a slight taper flaring upwards of the order of one degree or two degrees, conventionally on the peripheral surface of the burner, cannot satisfactorily solve all the difficulties mentioned above encountered during mould removal.

SUMMARY OF THE INVENTION

Therefore the purpose of this invention is to correct the above-mentioned disadvantage of known burners and to propose a burner of the type mentioned above in which mould removal is facilitated and which also has improved functional characteristics.

According to a first aspect of the invention, this catalytic combustion burner has a tapered peripheral surface flaring upwards.

Obviously, this peripheral surface is tapered much more than the slight taper mentioned above.

Thus, the tapered structure facilitates removal of the burner from its mould without damaging the peripheral surface of the burner.

Furthermore, during comparative tests of the operation of a burner according to the invention and of burners with a cylindrical structure according to prior art, the applicant made measurements demonstrating that better results are obtained in terms of odour destruction if a catalytic combustion flask is used fitted with a burner with a tapered structure.

It can be understood that the tapered burner according to the invention has a larger peripheral exchange surface area than a burner according to prior art with a comparable burner height and an approximately cylindrical peripheral surface, due to its inherent construction.

In the case of a burner with an approximately cylindrical peripheral surface, air circulating in the immediate vicinity of the peripheral surface of the burner warms up as it comes into contact with this surface and rises vertically parallel to the said surface of the burner. Therefore, the result is that contact between this hot air and the peripheral surface of the burner is only very slight, even in the case in which there is a slight taper of the order of 1° or 2° making this type of burner flare very slightly upwards. Therefore heat exchange and chemical exchanges between the peripheral surface of the burner and air are limited.

On the contrary, in the case of a burner with the same height but with a tapered peripheral surface, hot air circulating vertically close to the burner makes stronger contact with the tapered peripheral surface of the burner, thus facilitating heat and chemical exchanges and therefore catalytic destruction of fumes and other components carried by this hot air, thus enabling cleaner ambient air.

Furthermore, since heat exchanges are greater when a burner according to the invention is used, the air close to the burner that is more strongly heated rises more quickly and consequently generates more dynamic convection currents.

Therefore, better convection of gas flows is observed, for air and for gases produced by vaporisation of the combustible composition, in the immediate environment of tapered peripheral surface of the burner.

Preferably, the half-angle at the vertex of the tapered peripheral surface of the burner is between 10° and 40°, and is advantageously between 15° and 25°, and is preferably between 18° and 23°.

According to one advantageous version of the invention, the tapered peripheral surface of the burner has at least one shoulder approximately around the periphery and facing inwards and downwards to increase the diameter between a lower part and an upper part of the burner.

This type of structure further increases the exchange surface area between the hot air and the burner and reinforces contact between rising hot air and at least some of the peripheral surface of the burner, and therefore heat and chemical exchanges.

A second aspect of the invention also relates to a catalytic combustion flask adapted to contain a liquid combustible composition and to be fitted with a catalytic combustion burner at its neck, designed to cooperate with a wick dipping into the said composition.

According to the invention, this flask is fitted with a burner according to the first aspect of the invention.

Other special features and advantages of this invention will become clear after reading the following detailed description.

BRIEF DESCRIPTION OF THE DRAWINGS

In the appended drawings given simply as non-limitative examples.

The common elements to FIGS. 1 to 5 are identified by identical numeric references.

DETAILED DESCRIPTION OF THE PREFERRED EMBODIMENT(S)

Figure 1:
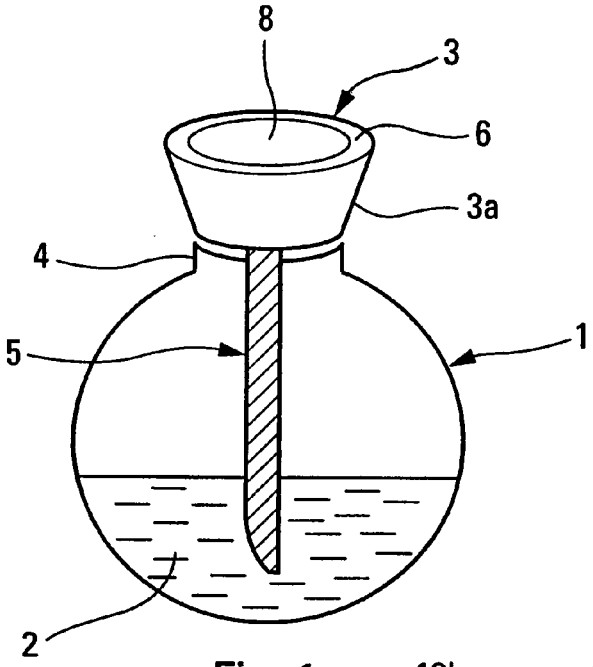
FIG. 1 is a diagrammatic view of an elevation of a flask equipped with a catalytic combustion burner according to a first embodiment of the present invention.

FIG. 1 shows a catalytic combustion flask 1 adapted to contain a combustible composition 2 and to be fitted with a catalytic combustion burner 3 conform with the invention at its top end.

This flask 1 may have any shape and has a neck 4 in which the catalytic combustion burner 3 can be fitted.

The catalytic combustion burner 3 is made from an appropriate porous material adapted to resist temperatures of at least 400° C. reached in the zone supporting the catalyst during operation of the burner 3. In particular, this material may be a ceramic material, for example it may be prepared from kaolin or cordierite.

The catalytic combustion burner 3 is adapted to cooperate with a wick 5 dipping into the said composition 2. This wick 5 will bring the combustible composition 2 to the burner 3, and this combustible composition 2 will penetrate into the pores of the porous material.

The combustible composition 2 is an appropriate combustible liquid in accordance with the regulations in force and adapted to catalytic combustion and vaporization.

In particular, this combustible composition 2 may be an alcohol, particularly isopropyl alcohol, and may also comprise a perfumed material and/or an active material.

The wick 5 is any known type of wick, for example a cotton wick.

The wick 5 may also be made of a mineral material, for example it may be made of mineral fibres or of a porous material.

The catalytic combustion burner 3 may be provided with a support (not shown) near the bottom, so that it can be introduced either directly into the neck 4 of the flask 1, or into the central hole of a base (not shown), the base being adapted so that it can be fixed at the neck 4 of the flask 1.

Support and basis suitable for fixing such a burner 3 on the flask 1 have been described particularly in application WO 99/63267.

Figure 2:
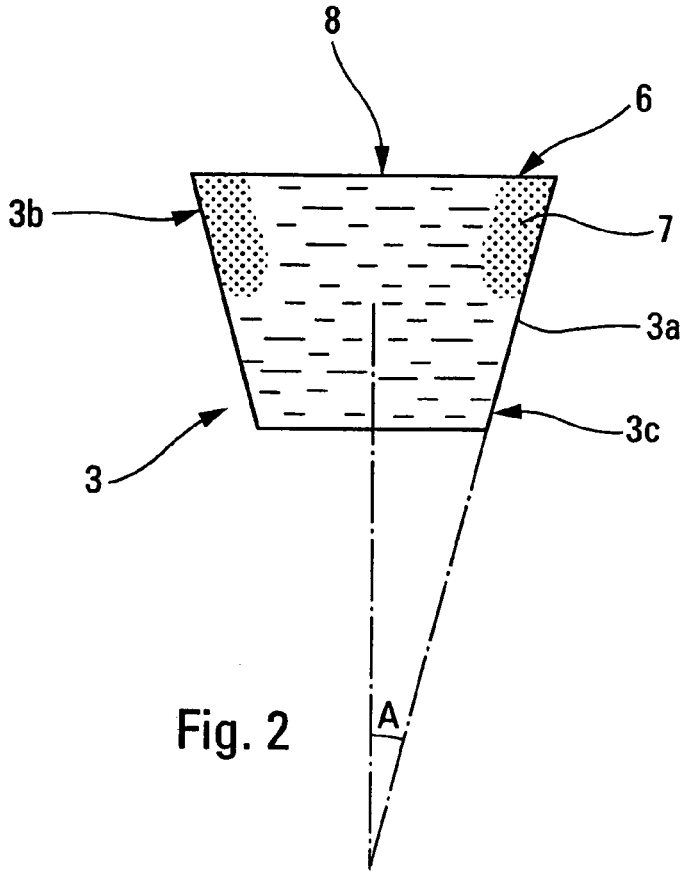
FIG. 2 is an enlarged diagrammatic view of an axial section of the burner shown in FIG. 1.

As shown in FIG. 2, the catalytic combustion burner 3 has a solid structure and a tapered peripheral surface 3*a* having a truncatedcone form, that flares upwards.

This burner 3 comprises a peripheral zone 6 near its top part 3*b*, for example with an annular shape, that supports a catalyst 7 and that surrounds a central zone 8 without a catalyst forming the vaporization zone.

For example, the catalyst 7 may be a metal belonging to group VIII in the periodic table of the elements.

The half-angle A at the summit of the tapered peripheral surface 3*a* of the burner 3 is between 10° and 40°, and is advantageously between 15° and 25°, and preferably between 18° and 23°.

Figure 3:
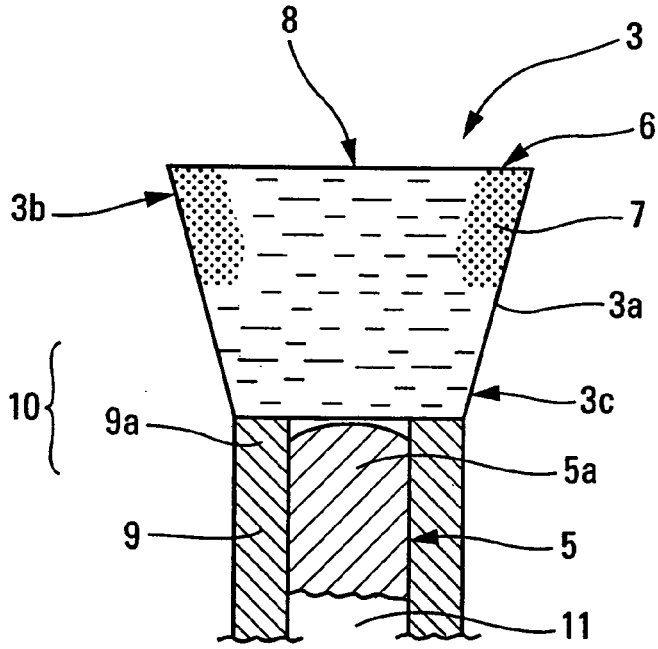
FIG. 3 is a view of the burner shown in FIG. 2 fitted with a sleeve.

The catalytic combustion burner 3 in FIG. 2 may be combined with a sleeve 9 so as to form a catalytic combustion system, like the catalytic combustion system 10 shown in FIG. 3.

This sleeve 9 is placed on the extension of the lower part 3*c* of the burner 3.

This sleeve 9 is also made from a porous material that may particularly be a ceramic material, for example prepared from kaolin or cordierite.

This sleeve 9 comprises an approximately axial cavity 11 designed to tighten the wick 5 so that the combustible composition 2 can migrate from the pores of the upper part 9*a* of the sleeve 9 towards the pores of the lower part 3*c* of the burner 3.

The junction between the lower part 3*c* of the burner 3 and the upper part 9*a* of the sleeve 9 must be such that migration of the combustible composition 2 from the sleeve 9 towards the burner 3 is guaranteed. The result is thus mechanical nesting and/or an assembly by means of porous bonding.

A catalytic combustion system 10 could also be made as a single part comprising the burner 3 and the sleeve 9.

Figure 4:
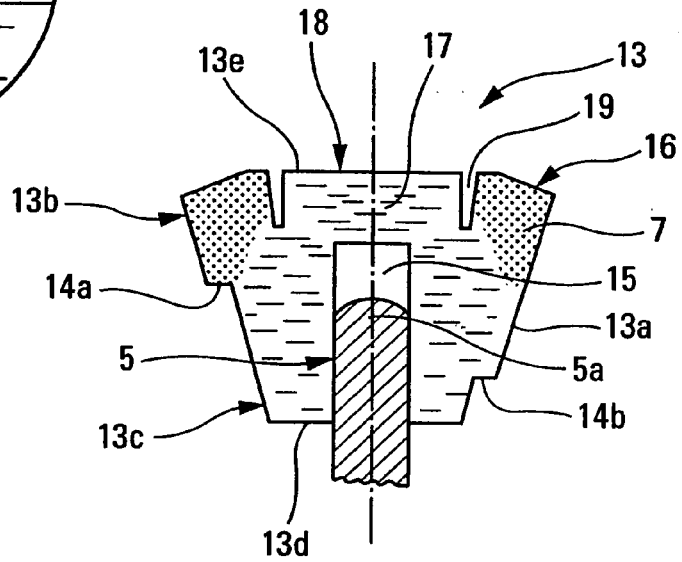
FIG. 4 is a view similar to FIG. 2 of a second embodiment of the burner according to this invention and comprising two half-views showing two variant positions of the first shoulder.

FIG. 4 shows two half views of a catalytic combustion burner 13 according to a second embodiment of the invention.

This burner 13 has a tapered peripheral surface 13*a* having a truncatedcone form, that is flared upwards.

Each half-view shows that this peripheral surface 13*a* has at least one approximately peripheral first shoulder 14*a*, 14*b*, facing inwards and downwards from the said burner 13.

The effect of this first shoulder 14*a*, 14*b* is to increase the diameter between a lower part 13*c* and an upper part 13*b* of the burner 13.

On the left half-view, the first shoulder 14*a* is arranged in the approximately median part of the burner 13.

On the right half-view, the first shoulder 14*b* is formed in the lower part 13*c* of the burner 13.

Obviously, the height of the first shoulder can be different from the heights shown on the two half-views in FIG. 4.

As shown on the left half view, the catalyst deposit was made as far as the first shoulder 14*a*, which therefore separates the peripheral zone 16 supporting the catalyst 7 from the lower part 13*c* of the burner 13 without a catalyst, at the peripheral surface 13*a* of the burner 13.

On the other hand, on the right half view, the first shoulder 14*b* does not correspond to a demarcation zone for localization of the catalyst 7 at the peripheral surface 13*a* of the burner 13. This first shoulder 14*b* is located in a part of the burner 13 in which there is no catalyst.

The burner 13 comprises a cavity 15 approximately axial open downwards, at least at its lower part 13*c*, into which fits the upper end 5*a* of the wick 5 that will convey the combustible composition 2 to the burner 13, over all or some of its height.

As shown in FIG. 4, the end 5*a* of the wick 5 only partially fills the volume of the cavity 15 of the burner 13. However, it will be quite possible for this end 5*a* to fill practically the entire cavity 15, as is the case for the burner 23 shown in FIG. 5.

On the view shown in FIG. 4, the cavity 15 that opens up at the lower end 3*d* of the burner 13 extends axially over a large part of the axial dimension of the burner 13.

This cavity 15 is closed off by a wall 17, at the top part 13*b* of the burner 13.

Conventionally, as shown in FIG. 4, the burner 13 has an approximately axial annular groove 19 extending downwards from the upper surface 13*e* of the burner 13 and separating the approximately annular peripheral zone 16 that supports the catalyst 7, from the central zone 18 of the upper part 13*b* of the burner 13.

This particular structure of the upper part 13*b* of such a burner 13 fitted with an annular groove 19 was described particularly in patent EP 0 277 875 B1 deposited by the applicant.

Figure 5:
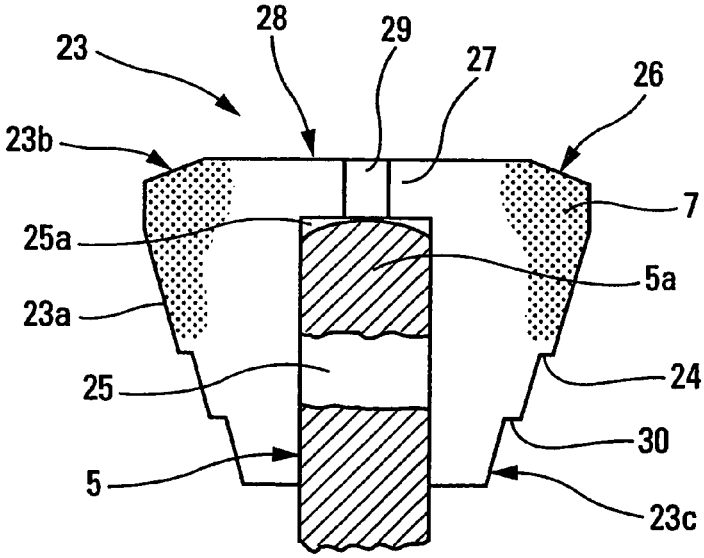
FIG. 5 is a view similar to FIG. 2 of a third embodiment of the burner according to this invention.

FIG. 5 shows a catalytic combustion burner according to a third embodiment of the invention.

As in the previous figures, this catalytic combustion burner 23 has a tapered peripheral surface 23*a* having a truncatedcone form, that flares upwards.

The upper part 23*b* of the burner 23 comprises an annular peripheral zone 26 supporting the catalyst 7 and surrounding a central zone 28 without catalyst, and a cavity 25.

The top part 25*a* of the cavity 25 communicates with the atmosphere through at least one open channel 29, for example formed in the top part 23*b* of the burner 23.

In this FIG. 5, the channel 29 is located at the centre of the central zone 28 and is approximately in the axial direction. However, there is no reason why this channel 29 cannot be arranged otherwise, in particular according to the arrangement shown in FIG. 8 in document WO 99/63267.

This channel 29 has a narrower cross section than the cross section of the cavity 25 of the burner 23, such that the cavity 25 is at least partially closed at the top part 23*b* of the burner 23, by a wall 27 located in the central zone 28.

The peripheral surface 23*a* comprises a first approximately peripheral shoulder 24, and a second approximately peripheral shoulder 30.

Each shoulder 24, 30 separates part of the burner 23 immediately above it and with a larger diameter, from another part of the burner 23 immediately below it and with a smaller diameter.

As shown in FIG. 5, this first shoulder 24 separates the annular peripheral zone 26 supporting the catalyst 7 from the lower part 23*c* of the burner 23 without a catalyst 7, at the peripheral surface 23*a* of the burner 23.

This type of structural arrangement provides a means of precisely determining the zone of the burner 23 on which the catalyst 7 will be deposited.

It would thus have been possible to plan to place the catalyst 7 as far as the second shoulder 30.

Obviously, this invention is not limited to the embodiments of the burner that have just been described, and many changes and modifications could be made to it without going outside the scope of the invention.

In particular, all of the different structural characteristics of the burners described above could be combined without restriction.

In particular, the burners 13 and 23 shown in FIGS. 4 and 5 could be provided with a sleeve like the sleeve 9 shown in FIG. 3.

An annular groove like the annular groove 19 in FIG. 2 could also be provided, to separate the annular peripheral zone 6 from the central zone 8 of burner 3 shown in FIGS. 2 and 3, and the annular peripheral zone 26 from the central zone 28 of burner 23 shown in FIG. 5.

Similarly, the top part of the cavity 15 of the burner 13 in FIG. 4 could also be connected to the atmosphere through a channel like that shown in FIG. 5 and marked with reference 29.

The lower parts 3*c*, 13*c* and 23*c* of burners 3, 13 and 23 can also be made in any appropriate shape to facilitate their placement and to support them on the neck 4 of the flask 1, possibly but not necessarily using a support and/or a base.

Remember that the support and base suitable for the attachment of such a burner 3, 13, 23 onto flask 1 were described particularly in application WO 99/63267.

The invention claimed is:

1. Catalytic combustion burner made from a porous material designed to cooperate with a wick that will carry a combustible composition to the burner that penetrates into the pores of the porous material, said burner comprising a peripheral zone that supports a catalyst and that surrounds a central zone without a catalyst forming a vaporization zone, the peripheral zone and the central zone being located in an upper part of the burner, said burner having a peripheral surface in contact with ambient air, said peripheral surface being provided with at least one first shoulder approximately around the periphery and facing inwards and downwards to increase a diameter between a lower part and the upper part of the burner, wherein said peripheral surface is tapered and has a truncated cone form flaring upwards, said peripheral surface allowing hot air circulating vertically close to the burner to make stronger contact with said burner and thus facilitating heat and chemical exchanges between the burner and the ambient air, wherein said first shoulder separates the peripheral zone supporting the catalyst from the lower part of the burner without the catalyst, and wherein at least part of the catalyst is supported by the peripheral surface having a truncated cone form flaring upwards.

2. The burner according to claim 1, wherein a half-angle at a vertex of the tapered peripheral surface is between 10° and 40°.

3. The burner according to claim 2, wherein a half-angle at a vertex of the tapered peripheral surface is between 15° and 25°.

4. The burner according to claim 2, wherein a half-angle at a vertex of the tapered peripheral surface is between 18° and 23°.

5. The burner according to claim 1, wherein the burner also comprises an approximately axial annular groove extending downwards from the upper surface of the burner and separating the peripheral zone from the central zone.

6. The burner according to claim 1, wherein the burner comprises an approximately axial cavity in a lower part open at the bottom, into which fits an upper end of the wick over all or some of its height, and at least partially closed at the upper part of the burner by a wall.

7. The burner according to claim 6, wherein an upper part of the cavity communicates with the atmosphere through at least one open channel.

8. The burner according to claim 7, wherein the at least one open channel is formed in the upper part of the burner.

9. Catalytic combustion flask, adapted to contain a combustible composition and to be fitted with a catalytic combustion burner at its neck, designed to cooperate with a wick dipping into said composition, said flask being fitted with a burner according to claim 1.

* * * * *